US009803812B2

(12) United States Patent
Kelly

(10) Patent No.: US 9,803,812 B2
(45) Date of Patent: Oct. 31, 2017

(54) GUIDE FOR STRAND OF ELECTRIC LIGHTS

(71) Applicant: Gary Kelly, Oak Grove, LA (US)

(72) Inventor: Gary Kelly, Oak Grove, LA (US)

( * ) Notice: Subject to any disclaimer, the term of this patent is extended or adjusted under 35 U.S.C. 154(b) by 189 days.

(21) Appl. No.: 14/685,222

(22) Filed: Apr. 13, 2015

(65) Prior Publication Data

US 2015/0292720 A1 Oct. 15, 2015

Related U.S. Application Data

(60) Provisional application No. 61/978,639, filed on Apr. 11, 2014.

(51) Int. Cl.

| | |
|---|---|
| ***F21S 4/00*** | (2016.01) |
| ***F21S 4/10*** | (2016.01) |
| ***F21S 4/26*** | (2016.01) |
| ***F21S 4/20*** | (2016.01) |
| ***F21V 3/02*** | (2006.01) |
| *F21W 121/04* | (2006.01) |

(52) U.S. Cl.
CPC . *F21S 4/10* (2016.01); *F21S 4/20* (2016.01); *F21S 4/26* (2016.01); *F21V 3/02* (2013.01); *F21W 2121/04* (2013.01)

(58) Field of Classification Search
CPC ..... F21S 4/10; F21S 4/26; F21S 4/20; F21V 3/02; F21W 2121/04
See application file for complete search history.

(56) References Cited

U.S. PATENT DOCUMENTS

| | | | | |
|---|---|---|---|---|
| 2,468,773 | A | 5/1949 | Muskinski | |
| 3,096,943 | A | 7/1963 | Forrer | |
| 4,404,621 | A | 9/1983 | Mauro | |
| 4,885,664 | A | 12/1989 | Hermanson | |
| 5,410,458 | A | 4/1995 | Bell | |
| 6,039,458 | A | 3/2000 | Coates, Jr. et al. | |
| 6,210,016 | B1 | 4/2001 | Prineppi | |
| 6,352,355 | B1 * | 3/2002 | Law | D04D 9/04 362/234 |
| 6,379,021 | B1 | 4/2002 | Shieh | |
| 6,840,655 | B2 | 1/2005 | Shen | |
| 8,376,584 | B1 | 2/2013 | Jenko et al. | |
| 2007/0183156 | A1 * | 8/2007 | Shan | B60Q 1/2611 362/277 |

* cited by examiner

*Primary Examiner* — Stephen F Husar
(74) *Attorney, Agent, or Firm* — Dunlap Codding, P.C.

(57) ABSTRACT

A guide for a strand of electric lights having a plurality of light elements spaced along an electric conductor. The guide includes a tubular body having an inlet end, an outlet end, and an oblong shaped passage extending through the tubular body from the inlet end to the outlet end. The passage dimensioned to slidably receive the light elements in a way that causes the light elements to be generally oriented along a major width of the passage as the light elements pass through the tubular body.

17 Claims, 5 Drawing Sheets

GUIDE FOR STRAND OF ELECTRIC LIGHTS

CROSS-REFERENCE TO RELATED APPLICATIONS

This application claims priority to U.S. Provisional Application Ser. No. 61/978,639, filed on Apr. 11, 2014, the entire content of which is hereby expressly incorporated herein by reference.

BACKGROUND

Decorating a tree with a strand of electric lights is a common way to illuminate a real or artificial tree. One such method for illuminating a tree includes wrapping a strand of electric lights around the tree by walking in a circle around the exterior of the tree while simultaneously disposing the strand of electric lights on the tree's outer branches. However, this method usually appears messy and does not illuminate the interior of the tree. In order to achieve an aesthetically pleasing effect and illuminate the exterior and interior of the tree, one must laboriously weave the strand of electric lights in and out of the interior branches of the tree. However, this is difficult and cumbersome, particularly with real trees, because the individual light elements, which often face in random opposing directions, may catch or snag on tree branches and on the strand itself as the strand is guided into the interior of the tree. This may result in tangled strands and branches and is frustrating to the decorator attempting to guide the strand of electric lights into the interior of the tree.

Some attempts have been made to solve deficiencies in decorating the interior of a tree. Examples include housing a strand of lights in a translucent tube and inserting the combination of the tube and the strand of lights into the interior of the tree. However, such a device is not aesthetically pleasing and fails to provide a traditional look because the plastic tube remains in the tree and about the lights. Another device requires a band with outwardly radiating strands of electric lights to be wrapped around the trunk of a tree. However, such a device does not address the problem of the light elements becoming entangled with the strand and the tree branches when positing the strand of electrical lights on a tree.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale, or in schematic in the interest of clarity and conciseness. Not every component may be labeled in every drawing. Like reference numerals in the figures may represent and refer to the same or similar element or function. In the drawings.

DETAILED DESCRIPTION OF EXEMPLARY EMBODIMENTS

Figure 1:
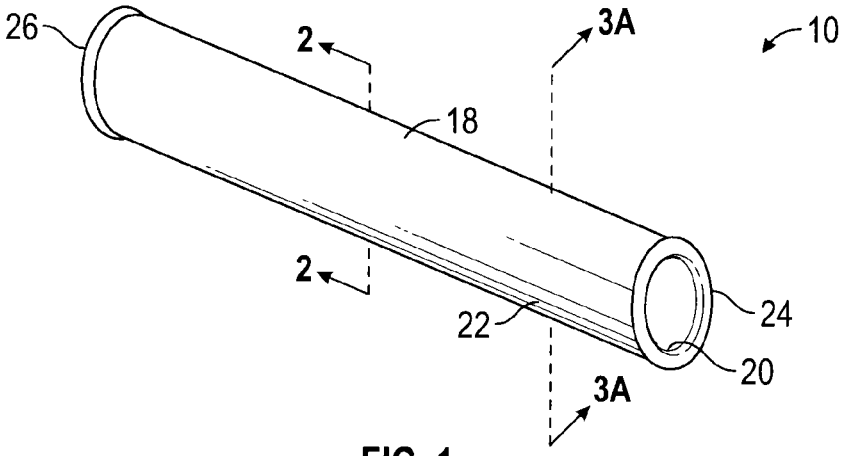
FIG. 1 is a perspective view of a guide constructed in accordance with the inventive concepts disclosed herein.

Before explaining at least one embodiment of the presently disclosed and claimed inventive concepts in detail, it is to be understood that the presently disclosed and claimed inventive concepts are not limited in their application to the details of construction, experiments, exemplary data, and/or the arrangement of the components set forth in the following description or illustrated in the drawings. The presently disclosed and claimed inventive concepts are capable of other embodiments or of being practiced or carried out in various ways. Also, it is to be understood that the phraseology and terminology employed herein is for purpose of description and should not be regarded as limiting.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers therebetween. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more of the features of the embodiments described herein.

Referring now to FIGS. 1-6, a guide 10 for use in facilitating the installation of a strand of electric lights 12 on an object, such as a Christmas tree 40 (FIG. 6), is illustrated. The strand of electric lights 12 is commonly referred to as a string of miniature Christmas lights and generally includes a plurality of light elements 14 spaced along an electric conductor 16 (depicted in FIGS. 4-6). It should be appreciated, however, that the form of the strand of electric lights 12 may vary and is not limited to the form associated with a string of miniature Christmas lights.

Figure 2:
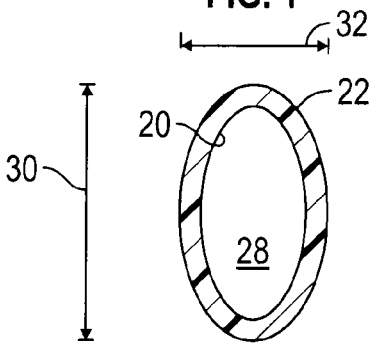
FIG. 2 is a cross-sectional view taken along the line 2-2 of FIG. 1.
Figure 4:
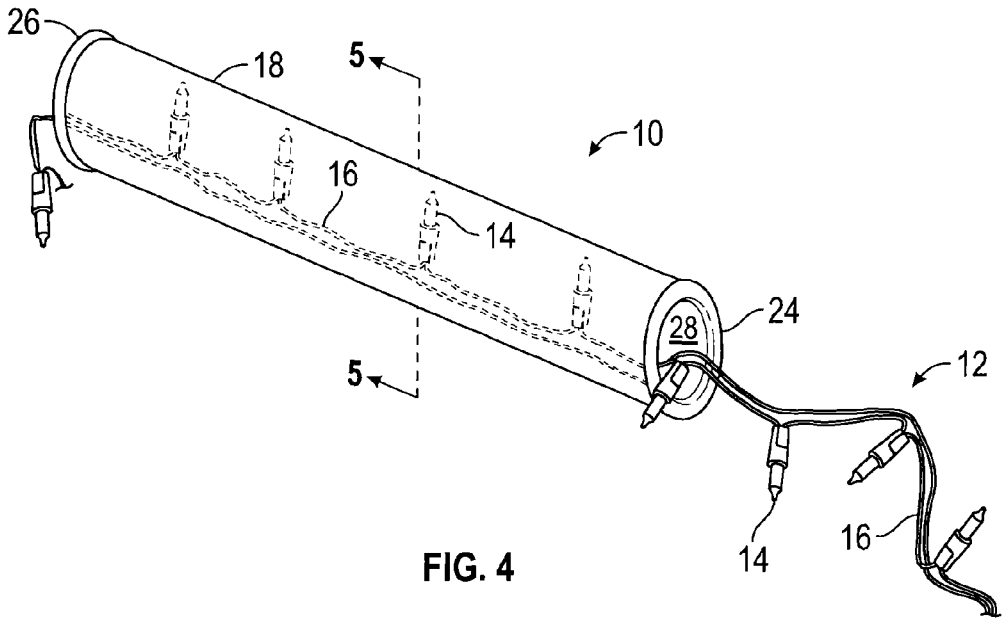
FIG. 4 is a perspective view of the guide of FIG. 1 illustrated with a strand of electric lights extending therethrough.

As shown in FIGS. 1-2, the guide 10 includes a tubular body 18 constructed for receiving the strand of electric lights 12. The tubular body 18 may be formed in a variety of lengths and widths. In one embodiment, the tubular body 18 may have a length in a range of about 23 inches to about 30 inches. The tubular body 18 may be translucent or opaque and includes an interior surface 20, an exterior surface 22, an inlet end 24, an outlet end 26, and a generally oblong shaped passage 28 (best shown in FIGS. 2 and 5) extending through the tubular body 18 from the inlet end 24 to the outlet end 26. As shown in FIGS. 2 and 4, the passage 28 is shown to be oval shaped, with a major width 30 and a minor width 32. It will be appreciated, however, that the passage 28 may be formed in a variety of oblong shapes, such as an eye, a diamond, and a rectangle, so long as the major width 30 and the minor width 32 are dimensioned to slidably receive the strand of electric lights 12 in a way that causes the light elements 14 to be generally oriented along the major width 30 as the light elements 14 pass through the passage 28. In one embodiment, the passage 28 is straight from the inlet end 24 to the outlet end 26 so that the strand of electric lights 12 efficiently passes through the oblong shaped passage 28. However, it should be appreciated that the passage 28 may also be curved.

Figure 5:
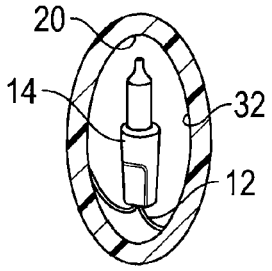
FIG. 5 is a cross-sectional view taken along the line 5-5 of FIG. 4.

As shown in FIGS. 2 and 5, the interior surface 20 of the tubular body 18 defines the passage 28. The passage 28 may be of a variety of sizes and shapes. However, in one embodiment the passage 28 is sized such that the minor width 32 is less than the length of the light elements 14, while the major width 30 is greater than the length of the light elements 16. While the exterior surface 22 of the tubular body 18 is shown as oval shaped in FIGS. 1-6 to facilitate movement through a tree, it should be appreciated that the exterior surface 22 may be constructed in a variety of shapes, such as circles and hexagons. The tubular body 18 may be formed of a suitable rigid or semi-rigid material. By way of example, the tubular body 18 may formed of a suitable plastic product, metal, wood fiber, or a paper product, such as cardboard.

Figure 3A:
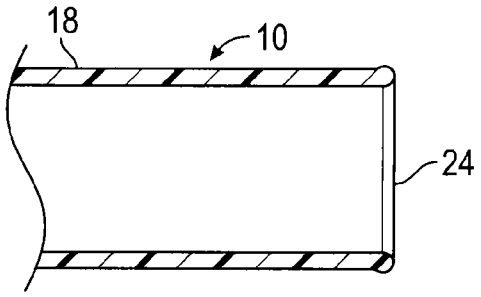
FIG. 3A is cross-sectional view taken along the line 3A-3A of FIG. 1.

In the embodiment shown in FIGS. 1, 3A and 4, the inlet end 24 and the outlet end 26 of the tubular body 18 may be rounded so that light elements 14 of a light strand pass freely into and out of the passage 28 without catching or snagging on the inlet end 24 or the outlet end 26.

Figure 3B:
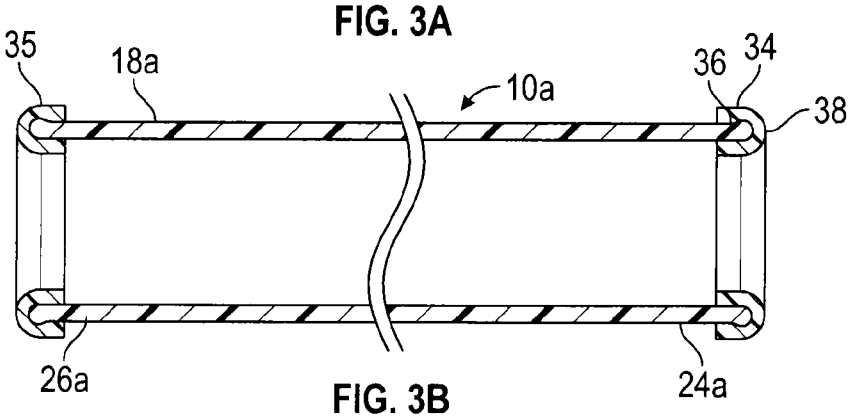
FIG. 3B is a cross-sectional view of another embodiment of a guide constructed in accordance with the inventive concepts disclosed herein.

FIG. 3B shows another embodiment of a guide 10*a*, which includes a tubular body 18*a*. The tubular body 18*a* is constructed substantially similar to the tubular body 18 except that the tubular body 18*a* does not include rounded ends. The tubular body 18*a* instead includes an inlet end 24*a* with a tubular inlet member 34 disposed on the inlet end 24*a* and an outlet end 26*a* with a tubular outlet member 35 disposed on the outlet end 26*a*. The inlet member 34 and the outlet member 35 each have a proximal end 36 and a distal end 38. The distal ends 38 of each inlet and outlet member 34 and 35 are rounded so that light elements on a strand of electric lights, such as light elements, pass freely into and out of the passage 28 without catching or snagging on the distal ends 38 of the inlet and outlet members 34 and 35. The inlet member 34 and the outlet member 35 are constructed to conform to the generally oblong shaped passage of the tubular body 18*a* and may be formed of a suitable resinous or plastic material and sealed or molded to the first end 24*a* and the second end 26*a*, respectively, after the tubular body 18*a* is formed by extrusion, for example.

Figure 6:
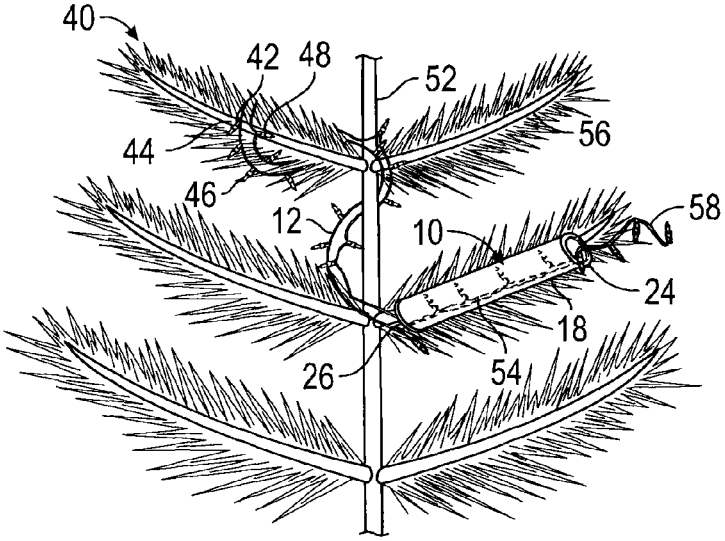
FIG. 6 is a diagrammatic view illustrating the use of the guide of FIG. 1.

Referring now to FIGS. 4-6, a method of positioning a stand of lights 12 to an object, such as the Christmas tree 40, using the guide 10 is described. First, a leading end 42 of the strand of electric lights 12 is passed through the tubular body 18 so that at least a portion of the strand of electric lights 12 extends from the outlet end 26 of the tubular body 18. In one embodiment, the light elements 14 of the light strand 12 are radially aligned (as shown in FIG. 4) as the light elements 14 pass through the tubular body 18.

After the leading end 42 is passed through the tubular body 18, the outlet end 26 of the tubular body 18 is positioned at a selected location 44 of the Christmas tree 40. Next, the portion of the strand of electric lights 12 extending form the outlet end 26 of the tubular body 18 is disposed on the Christmas tree 40 near the selected portion 44. An additional portion 46 of the strand of lights 14 may then be passed through the tubular body 18 and from the outlet end 26 thereof. While passing the additional portion 46 of the strand of electric lights 12 through tubular body 18, the outlet end 26 of the tubular body 18 is selectively moved about the Christmas tree 40 and its branches. Additional portion 46 of the strand of lights 14 may then be disposed on another selected location 48 of the Christmas tree 40 near where the additional portions 46 of the strand of electric lights 12 emerged from the outlet end 26 of the tubular body 18 while it was being selectively moved about the Christmas tree 40.

As shown in FIG. 6, the outlet end 26 of the tubular body 18 may then be positioned at another selected location 52 of the tree 40. An additional portion 54 of the strand of electric lights 12 is passed through the tubular body 18 and from the outlet end 26 thereof while the tubular body 18 is selectively moved about the Christmas tree 40 to a selected portion 56 of the Christmas tree 40 where yet another portion of the strand of electric lights 12 is disposed near where the strand of electric lights 12 emerges from the outlet end 26 of the tubular body 18. A trailing end 58 of the strand of electric lights 12 extending from the inlet end 24 of the tubular body 18 is passed through the tubular body 18 and disposed on a selected location of the Christmas tree 40 or plugged into an electric power source such as a wall outlet.

The guide 10 provides an apparatus for easily and efficiently reaching the interior of the Christmas tree 40 where the strand of electric lights 12 is disposed by creating a conduit through which the strand of electric lights 12 freely passes without interference from the Christmas tree 40 and without becoming entangled with the strand of electric lights 12 itself. The guide 10 further aids a tree decorator in weaving a strand of electric lights 12 in and out of a section of tree branches while preventing the strand 12 from entangling with various portions of the strand 12 and from catching on the branches at undesirable locations. The guide 10 therefore provides a way to illuminate the interior of a tree with increased ease while maintaining a traditional look of a tree that has been carefully and laboriously lit.

Figure 7:
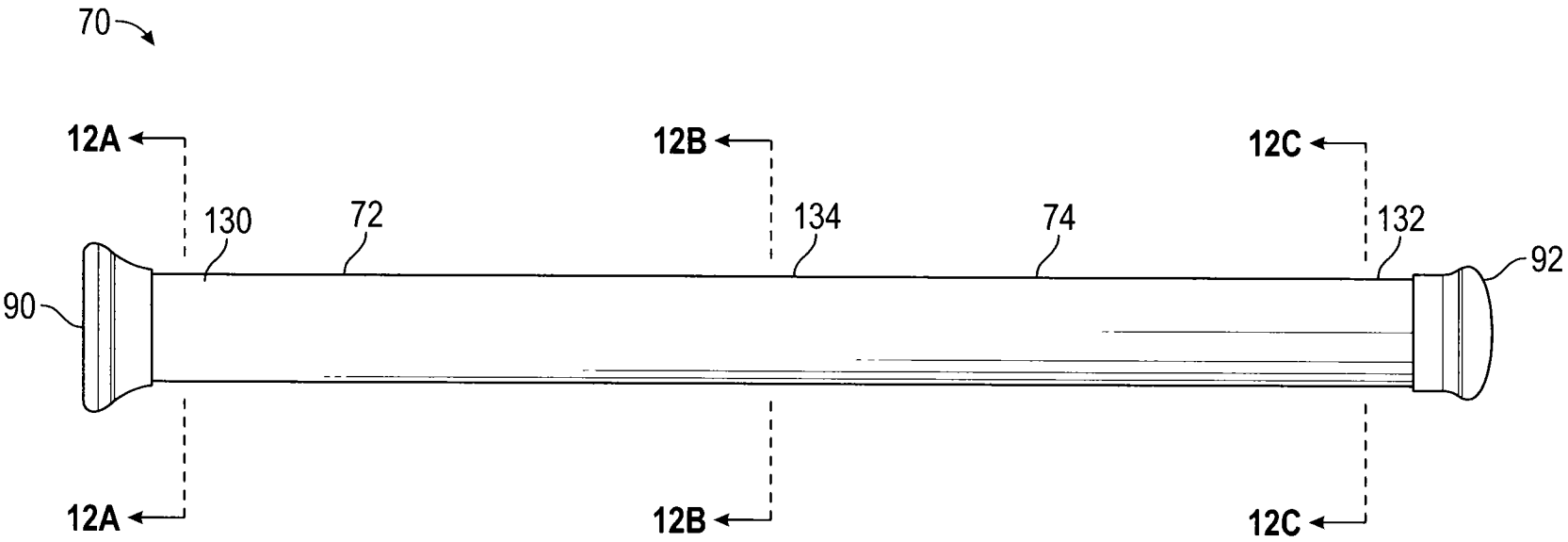
FIG. 7 is a side elevational view of another embodiment of a guide constructed in accordance with the inventive concepts disclosed herein.

Referring now to FIG. 7, another embodiment of a guide 70 is shown. The guide 70 includes a tubular body 72 constructed for receiving a strand of lights, such as strand of electric lights 12. The tubular body 72 has an external surface 74, an internal surface 76, an inlet end 78, an outlet end 80, and a passage 82 extending through the tubular body 72 from the inlet end 78 to the outlet end 80. In one embodiment, the passage 82 is oblong shaped with a major width and a minor width dimensioned to slidably receive the strand of electric lights 12 in a way that causes light elements on the strand 12, such as light elements 14, to be generally oriented along the major width of the passage 82 as the light elements 14 pass through the passage 82. The passage 82 is shown to be generally eye shaped, but it will be appreciated that the passage 82 may be formed in a variety of oblong shapes, such as an oval, a diamond, and a rectangle.

The tubular body 72 may be constructed of substantially similar materials as those of the tubular body 18 and of substantially similar processes. The length of the tubular body 72 may be between, but is not limited to being in a range of 23 inches to about 30 inches. Specifically, in at least one embodiment, the length of the tubular body 72 may be about 26 inches. The thickness of tubular body 72 (from the external surface 74 to the internal surface 76) may be between, but is not limited to being between, about 1/18 inch to about 1/14 inch. Specifically, in at least one embodiment, the tubular body 72 may be about 1/16 inch thick.

As shown in FIG. 7, a tubular inlet member 90 may be disposed on the inlet end 78 of the tubular body 72, and a tubular outlet member 92 may be disposed on the outlet end 80 of the tubular body 72.

Figure 8A:
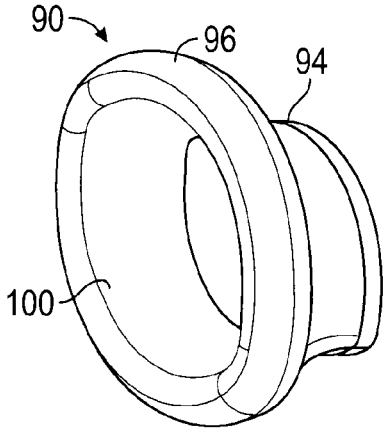
FIG. 8A is a perspective view of a tubular inlet member constructed in accordance with the inventive concepts disclosed herein.
Figure 8B:
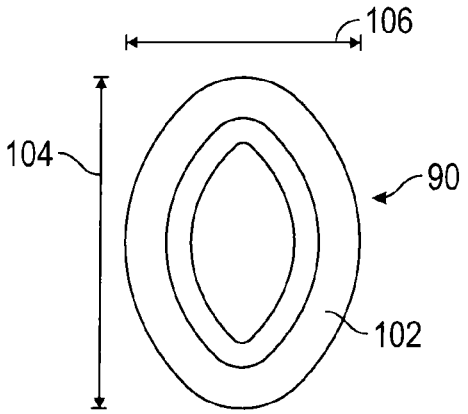
FIG. 8B is an end view of the tubular inlet member of FIG. 8A.
Figure 9:
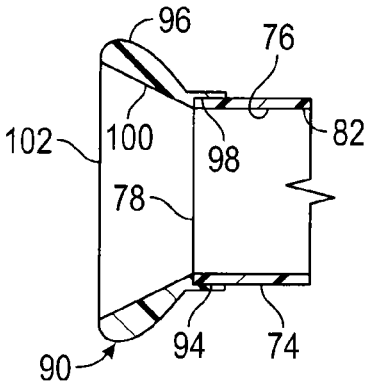
FIG. 9 is a cross-sectional view of the tubular inlet member shown positioned on an inlet end of a tubular body.

Referring now to FIGS. 8A-9, the tubular inlet member 90 may include a collar portion 94 and a bell portion 96. The collar portion 94 has a shoulder 98 for abutting the inlet end 78 to create a substantially flush surface extending from an internal surface 100 of the bell portion 96 to the internal surface 76 of the tubular body 72. In this way, the strand of electric lights 12 may traverse from the internal surface 100 of the bell portion 96 to the internal surface 76 of the tubular body 72, and vice versa, without snagging on the inlet end 78 of the tubular body 72.

The internal surface 100 of the bell portion 96 flares from the collar portion 94 towards a mouth 102. As such, the tubular inlet member 90 is flared relative to the tubular body 72 so that light elements of a variety of shapes and sizes may funnel into the tubular body 72 through the tubular inlet member 90.

The mouth 102 may have an oblong shape with a major width 104 and a minor width 106. The bell portion 96 is dimensioned to cause light elements of various shapes and sizes to orient with the major width 104 of the mouth 102 so that the light elements are generally oriented along the major width of the passage 82 as they enter the passage 82. The major width 104 of the mouth 102 of the tubular inlet member 90 may be greater than the major width of the passage 82, and the minor width 106 of the mouth portion 102 may be greater than the minor width of the passage 82. In this way, the tubular body 72 may accommodate the entry of light elements of a variety of shapes and sizes into the tubular body 72 from the inlet end 78.

Figure 10A:
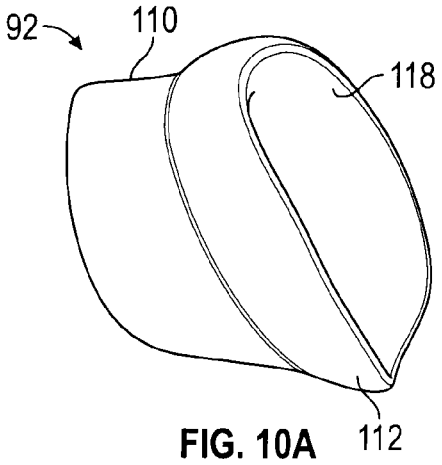
FIG. 10A is a perspective view of a tubular outlet member constructed in accordance with the inventive concepts disclosed herein.
Figure 10B:
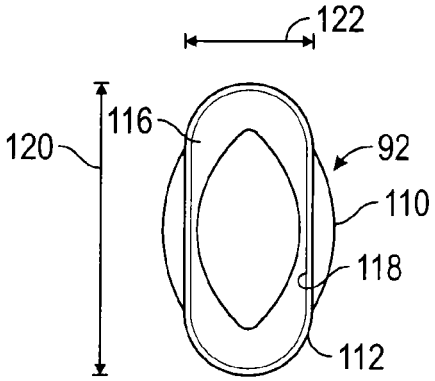
FIG. 10B is an end view of the tubular outlet member of FIG. 10A.
Figure 11:
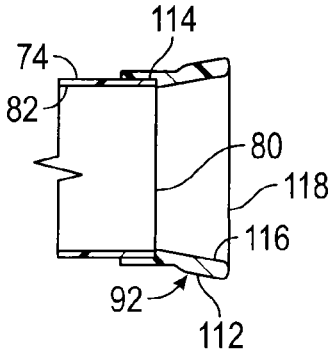
FIG. 11 is a cross-sectional view of the tubular outlet member shown positioned on an outlet end of the tubular body.
Figures 12A, 12B, 12C:
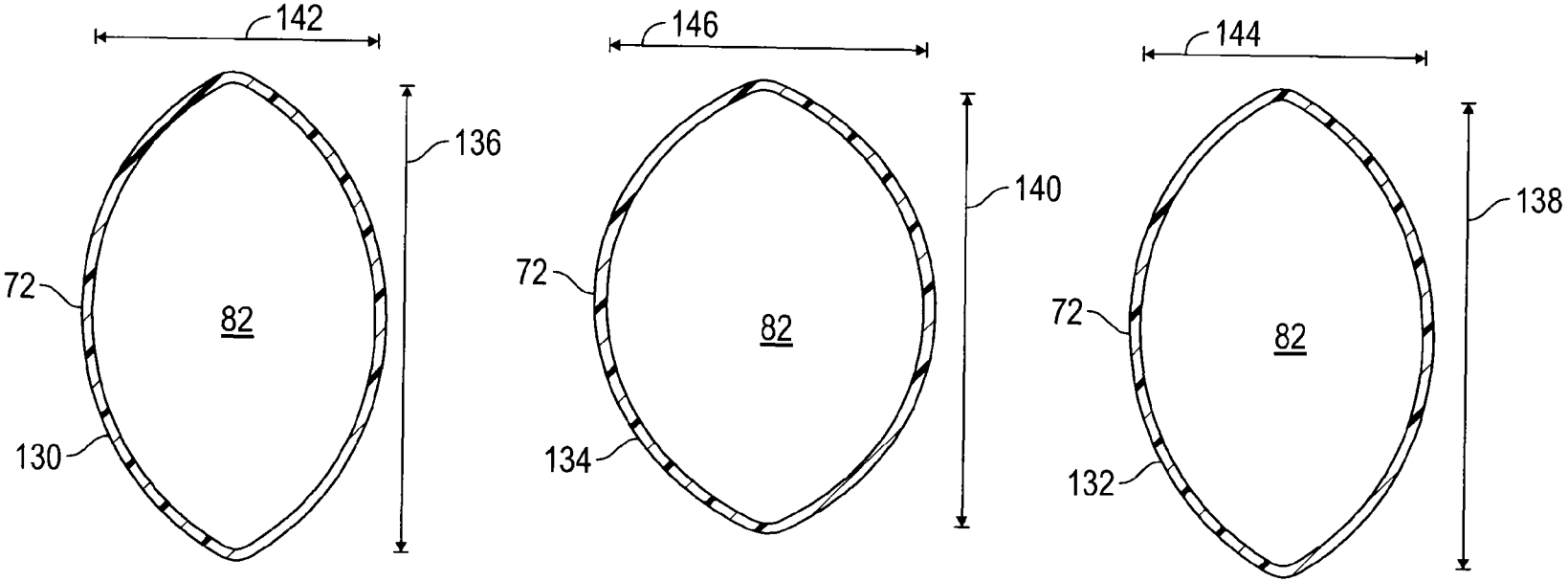
FIG. 12A is a cross-sectional view taken along line 12A-12A of FIG. 7.
FIG. 12B is a cross-sectional view taken along line 12B-12B of FIG. 7.
FIG. 12C is a cross-sectional view taken along line 12C-12C of FIG. 7.

Referring now to FIGS. 10A-11, the tubular outlet member 92 may include a collar portion 110 and a bell portion 112. The collar portion 110 has a shoulder 114 for abutting the outlet end 80 of the tubular body 72 to create a substantially flush surface extending from the internal surface 76 of the tubular body 72 to an internal surface 116 of the bell portion 112. In this way, the strand of electric lights 12 may traverse from the internal surface 76 of the tubular body 72 to the internal surface 116 of the bell portion 112, and vice versa, without snagging on the outlet end 80.

The internal surface 116 of the bell portion 112 flares from the collar portion 110 towards a mouth 118 such that the tubular outlet member 92 is flared relative to the tubular body 72. In this way, light elements of a variety of shapes may freely exit the tubular body 72 through the tubular outlet member 92, which facilitates the positioning of a strand of electrical lights on to a branch of a tree.

The mouth 116 of bell portion 114 of the tubular outlet member 92 has a major width 120 and a minor width 122. The major width 120 of the mouth portion 116 of the tubular outlet member 90 may be greater than the major width of the tubular body 72. Conversely, the minor width 122 may be less than the minor width of the tubular body 72. In this way, the tubular outlet member 92 serves as a narrow navigational point relative to the tubular body 72 and facilitates positioning of the tubular body 72 in and out a section of tree branches. The bell portion 114 is dimensioned to cause light elements to orient with the major width 120 of the mouth 116 so that the light elements are generally facing the same direction as they exit the tubular outlet member 92 and are disposed on a branch of a tree.

The tubular inlet member 90 and the tubular outlet member 92 may be formed of a suitable resinous or plastic material and sealed or molded to the inlet end 78 and the outlet end 80, respectively, after the tubular body 72 is formed by extrusion, for example. However, it should be appreciated that the tubular inlet member 90, the tubular body 72, and the tubular outlet member 92 may be formed as a single piece.

Referring now to FIGS. 7 and 12A-12C, the tubular body 72 has a first end portion 130, a second end portion 132, and a medial portion 134. In one embodiment, the tubular body 72 is configured so that the oblong passage 82 has a major width 136, 138, 140 and minor width 142, 144, and 146 at each of the first end portion 130, second end portion 132, and medial portion 134, respectively. More particularly, when the tubular inlet member 90 and the tubular outlet member 92 are so disposed on the inlet end 78 and the outlet end 80, respectively, the tubular body 72 may be shaped in a way that the major width 136 of the passage 82 at the first end potion 130 and the major width 138 of the passage 82 at the second end portion 132 is greater than the major width 140 at the medial portion 134. Also, when the tubular inlet member 90 and the tubular outlet member 92 are disposed on the inlet end 78 and the outlet end 80, respectively, the minor width 142 of the oblong passage 82 at the first end potion 130 and the minor width 144 of the oblong passage 82 at the second end portion 132 may be less than the minor width 146 of the oblong passage 82 at the medial portion 134. Therefore, the passage 82 becomes wider and shorter from the inlet end 78 towards the medial portion 134, and the passage 82 becomes wider and shorter from the outlet end 80 towards the medial portion 134. This change in the major and minor widths of the passage 82 from the inlet end 78 to the outlet end 80 may prevent light elements from becoming wedged inside the tubular body 72 as the strand of electric lights 12 is moved back and forth through the passage 82.

The size of the major width 136 at the first end 130 and the size of the major width 138 at the second end 132 may be, but is not limited to being, in a range of about 1¼ inches to about 3¾ inches. Specifically, in at least one embodiment, the major width 136 and the major width 138 may be about 2¾ inches. The size of the major width 140 at the medial portion 134 may be, but is not limited to being, in a range of about 2 inches and about 3½ inches. Specifically, in at least one embodiment, the major width 140 may be about 2 9/16 inches.

The size of the minor width 142 at the first end 130 and the size of the minor width 144 at the second end 132 may be, but is not limited to being, in a range of about ¾ of an inch to about 2½ inches. Specifically, in at least one embodiment, the minor width 142 and the minor width 144 may be about 1 13/16 of an inch. The size of the minor width 146 at the medial portion 134 may be, but is not limited to being, in a range of about 1 inch and about 3 inches. Specifically, in at least one embodiment, the minor width 146 may be about 2 inches.

Although the disposition of the tubular inlet member 90 and the tubular outlet member 92 about the inlet end 78 and the outlet end 80, respectively, is described in the embodiment herein as being the cause of the changes in the major and minor widths of the passage 82, it should be appreciated that the differing major and minor widths at the first end portion 130, the second end portion 132, and the medial portion 134 of the tubular body 72 may be achieved by other processes such as extrusion or molding, for example. It should also be appreciated that the tubular body 72 may consist of a single piece that flares at an inlet end and that flares at an outlet end without the disposition of the tubular inlet and outlet members on each respective end.

Further, while the embodiments of the guide have been particularly described with respect to positioning a strand of electric lights on a Christmas tree, it should be appreciated that guides constructed in accordance with the inventive concepts disclosed herein are not limited to such a specific application. For example, inventive concepts disclosed herein may be used to position a strand of electric lights or other decorations on objects such as, but not limited to, shrubs, a sculpture, a coat rack, a street sign, or a building structure, such as a house.

From the above description, it is clear that the present inventive concept is well adapted to carry out the objects and to attain the advantages mentioned herein as well as those inherent in the invention. While exemplary embodiments of the invention have been described for purposes of this disclosure, it will be understood that numerous changes may be made which will readily suggest themselves to those skilled in the art and which are accomplished within the spirit of the inventive concept disclosed and claimed herein.

What is claimed is:

1. A guide for a strand of electric lights, the strand of electric lights having a plurality of light elements spaced along an electric conductor, the guide comprising:

a tubular body having an open inlet end, an open outlet end, and an oblong shaped passage extending through the tubular body from the open inlet end to the open outlet end, the oblong shaped passage having a major width and a minor width dimensioned to slideably receive the strand of electric lights in a way that causes the light elements to be generally oriented along the major width as the light elements pass through the oblong passage from the open inlet end to the open outlet end, wherein the tubular body member has a first end portion, a second end portion, and a medial portion, wherein the passage of the tubular body has a major width and a minor width at each of the first end portion, the second end portion, and the medial portion, wherein the major width of the passage at the first end portion and the second end portion is greater than the major width of the passage at the medial portion, and wherein the minor width of the passage at the first end portion and the second end portion is less than the minor width of the passage at the medial portion.

2. The guide of claim 1, wherein the inlet end and the outlet end of the tubular body are rounded.

3. The guide of claim 1, wherein the tubular body is translucent.

4. A guide for a strand of electric lights, the strand of electric lights having a plurality of light elements spaced along an electric conductor, the guide comprising:

a tubular body having an open inlet end, an open outlet end, and an oblong shaped passage extending through the tubular body from the open inlet end to the open outlet end, the oblong shaped passage having a major width and a minor width dimensioned to slideably receive the strand of electric lights in a way that causes the light elements to be generally oriented along the major width as the light elements pass through the oblong passage from the open inlet end to the open outlet end, wherein the inlet end of the tubular body is flared.

5. The guide of claim 4, wherein the outlet end of the tubular body is flared.

6. A guide for a strand of electric lights, the strand of electric lights having a plurality of light elements spaced along an electric conductor, the guide comprising:

a tubular body having an open inlet end, an open outlet end, and an oblong shaped passage extending through the tubular body from the open inlet end to the open outlet end, the oblong shaped passage having a major width and a minor width dimensioned to slideably receive the strand of electric lights in a way that causes the light elements to be generally oriented along the major width as the light elements pass through the oblong passage from the open inlet end to the open outlet end; and a tubular inlet member disposed on the inlet end of the tubular body, the tubular inlet member being flared relative to the tubular body.

7. The guide of claim 6, wherein the tubular body has a major width and a minor width, and wherein the tubular inlet member has a major width greater than the major width of the tubular body and a minor width greater than the minor width of the tubular body.

8. The guide of claim 6, further comprising a tubular outlet member disposed on the outlet end of the tubular body, the tubular outlet member being flared relative to the tubular body.

9. The guide of claim 7, wherein the tubular body has a first end portion, a second end portion, and a medial portion, wherein the passage of the tubular body has a major width and a minor width at each of the first end portion, the second end portion, and the medial portion, wherein the major width of the passage at the first end portion and the second end portion is greater than the major width of the passage at the medial portion, and wherein the minor width of the passage at the first end portion and the second end portion is less than the minor width of the passage at the medial portion.

10. A guide for a strand of electric lights, the strand of electric lights having a plurality of light elements spaced along an electric conductor, the guide comprising:

a tubular body having an open inlet end, an open outlet end, and an oblong shaped passage extending through the tubular body from the open inlet end to the open outlet end, the oblong shaped passage having a major width and a minor width dimensioned to slideably receive the strand of electric lights in a way that causes the light elements to be generally oriented along the major width as the light elements pass through the oblong passage from the open inlet end to the open outlet end, wherein the tubular body has a major width and a minor width, and wherein the guide further comprises a tubular outlet member having a major width and a minor width with the minor width of the tubular outlet member being less than the minor width of the tubular body.

11. The guide of claim 10, wherein the major width of the tubular outlet member is greater than the major width of the tubular body.

12. A guide for a strand of electric lights, the strand of electric lights having a plurality of light elements spaced along an electric conductor, the guide comprising:

a tubular body having an open inlet end, an open outlet end, a first end portion, a second end portion, a medial portion, a major width, a minor width, and an oblong shaped passage extending through the tubular body from the inlet end to the outlet end, the passage of the tubular body having a major width and a minor width at each of the first end portion, the second end portion, and the medial portion with the major width of the passage at the first end portion and the second end portion being greater than the major width of the passage at the medial portion and the minor width of the passage at the first end portion and the second end portion being less than the minor width of the passage at the medial portion;

a tubular inlet member disposed on the inlet end of the tubular body, the tubular inlet member being flared relative to the tubular body; and a tubular outlet member disposed on the outlet end of the tubular body, the tubular outlet member being flared relative to the tubular body and having a major width and a minor width with the minor width of the tubular outlet member being less than the minor width of the tubular body, wherein the tubular inlet member, the tubular body, and the tubular outlet member cooperate to slidably receive the strand of electric lights in a way that causes the light elements to be generally oriented along the major width of the passage as the light elements pass through tubular inlet member, the tubular body, and the tubular outlet member.

13. The guide of claim 12, wherein a distal end of the tubular inlet member is rounded.

14. The guide of claim 12, wherein the tubular inlet member has a major width greater than the major width of the tubular body and a minor width greater than the minor width of the tubular body.

15. The guide of claim 12, wherein the major width of the tubular outlet member is greater than the major width of the tubular body.

16. A method of positioning a strand of electric lights on a tree, the strand of electric lights having a plurality of light elements spaced along an electric conductor, the method comprising:

passing a leading end of the strand of electric lights through a tubular body so that at least a portion of the strand of electric lights extends from an outlet end of the tubular body;

positioning the outlet end of the tubular body at a selected location of the tree;

disposing the portion of the strand of electric lights extending from the outlet end of the tubular body on a selected portion of the tree located near the selected location of the tree;

passing additional portions of the strand of electric lights through the tubular body and from the outlet end thereof while moving the outlet end of the tubular body selectively about the tree;

disposing the additional portions of the strand of electric lights extending from the outlet end of the tubular body on selected branches located near where the additional portions of the strand of electric lights emerged from the outlet end of the tubular body; and passing a trailing end of the strand of electric lights through the tubular body.

17. The method of claim 16, wherein the tubular body has an oblong passage with a major width and a minor width, and wherein the method further comprises:

causing the light elements to be generally oriented along the major width of the passage as the light elements pass through tubular body.

* * * * *